US006578477B2

(12) United States Patent
Yanagi et al.

(10) Patent No.: US 6,578,477 B2
(45) Date of Patent: Jun. 17, 2003

(54) STENCIL PRINTING MACHINE AND PRINTING DRUM THEREOF

(75) Inventors: Eiko Yanagi, Ibaraki (JP); Kazuo Nakano, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/921,689

(22) Filed: Aug. 6, 2001

(65) Prior Publication Data

US 2002/0017210 A1 Feb. 14, 2002

(30) Foreign Application Priority Data

Aug. 4, 2000 (JP) ..... 2000-237123

(51) Int. Cl.[7] ..... B41L 13/04
(52) U.S. Cl. ..... 101/116; 101/484
(58) Field of Search ..... 101/114, 116, 101/118, 129, 484

(56) References Cited

U.S. PATENT DOCUMENTS 5,517,913 A * 5/1996 Oshio et al. ..... 101/119
5,537,920 A * 7/1996 Hasegawa et al. ..... 101/116
5,632,200 A * 5/1997 Fukai ..... 101/116
5,699,731 A * 12/1997 Hara ..... 101/119
6,026,744 A * 2/2000 Miyata ..... 101/118
6,158,337 A * 12/2000 Hara ..... 101/116
6,295,924 B1 * 10/2001 Nishihata et al. ..... 101/116

FOREIGN PATENT DOCUMENTS

EP 888899 * 1/1999
EP 1000766 * 5/2000

* cited by examiner

*Primary Examiner*—Stephen R. Funk
(74) *Attorney, Agent, or Firm*—Sughrue Mion, PLLC

(57) ABSTRACT

A printing drum (2), to which a stencil sheet having subjected to a stencil making process is attached, can be attached to and removed from a printer main body (1). A nonvolatile memory (25) is provided in the printing drum. The number of print products is stored in the nonvolatile memory as "Information on the use" of the printing drum. A control device (5) of the printer main body reads out "Information on the use" from the nonvolatile memory and stores them in a RAM (12) when the printing drum is attached to the printer main body. Subsequently, when printing is performed, information on the number of print products is updated. When the printing drum is removed from the printer main body, "Information on the use" is updated and written into the nonvolatile memory.

10 Claims, 11 Drawing Sheets

FIG. 2

| | ITEMS | REMARKS |
|---|---|---|
| i | SERIAL NUMBER | |
| ii | TYPE CODE 1 | MANAGEMENT CATEGORY 1 |
| iii | TYPE CODE 2 | MANAGEMENT CATEGORY 2 |
| iv | THE NUMBER OF PRINT PRODUCTS | LIFE VALUE |
| v | THE NUMBER OF STENCIL SHEETS | LIFE VALUE |
| vi | THE NUMBER OF TIMES SCREEN IS REPLACED | LIFE VALUE |
| vii | THE NUMBER OF PRINT PRODUCTS PRODUCED BY SINGLE STENCIL | LIFE VALUE |
| viii | THE NUMBER OF TIMES DRUM IS REMOVED AND ATTACHED | LIFE VALUE |
| ix | MAXIMUM PAPER SIZE | FIXED VALUE |
| x | MINIMUM PAPER SIZE | FIXED VALUE |
| xi | PRINT PRODUCE COUNT VALUE | |
| xii | STENCIL SHEET COUNT VALUE | |
| xiii | PER-STENCIL PRINT PRODUCT COUNT VALUE | |
| xiv | SCREEN COUNT INFORMATION VALUE | HISTORY OF REPLACEMENT ASSOCIATED WITH THE NUMBER OF PRINT PRODUCTS |
| xv | DRUM REMOVAL AND ATTACHMENT COUNT NUMBER | |
| xvi | EMPLOYED COLOR | |
| xvii | PRINT END DATE AND TIME | |
| xviii | UPDATE CHECK INFORMATION | INFORMATION TO BE USED FOR DETERMINING WHETHER OR NOT DATA HAVE BEEN UPDATED NORMALLY |
| xix | USER INFORMATION AND OTHER INFORMATION ITEMS | |

STENCIL PRINTING MACHINE AND PRINTING DRUM THEREOF

BACKGROUND OF THE INVENTION

1. Field of the Invention

The present invention relates to a stencil printing machine in which printing operation is performed while a stencil sheet is attached to a printing drum. More particularly, the present invention relates to a stencil printing machine and a printing drum thereof, which can readily obtain information on use of a printing drum removably attached to a printer main body.

The present application is based on Japanese Patent Application No. 2000-237123, which is incorporated herein by reference.

2. Description of the Related Art

A stencil printing machine is constructed such that a printing drum is removably attached to a printer main body. A stencil sheet that has been subjected to a stencil making process is attached to the printing drum. Ink is provided in the printing drum. At the time of printing operation, the stencil sheet is perforated, and a predetermined image is formed on printing paper through the thus-formed perforates.

The printing drum is removable from the printer main body, and hence grasping the status of use of the printing drum is difficult.

The number of print products and stencil sheets produced can be ascertained by glancing at a counter provided on the printer main body. However, these numbers indicate all the print products and all the stencil sheets which have been produced and employed in the printer main body. In the event of occurrence of a problem due to the state of use of a printing drum; particularly, a problem due to reaching the life of a printing drum, a determination cannot be made readily as to whether or not the problem is ascribable to the printer main body or a printing drum.

SUMMARY OF THE INVENTION

The present invention has been conceived to solve the above problem, and an object of the present invention is to provide a stencil printing machine and a printing drum thereof, which enable accurate management of use of a printing drum removably attached to a printer main body.

To achieve the object, according to a first aspect of the present invention, there is provided a printing drum, to which a stencil sheet having subjected to a stencil making process is attachable, and which is attachable to a printer main body of a stencil printing machine for performing printing. The printing drum comprises a storage device which stores information on use of the printing drum.

According to a second aspect of the present invention, preferably, the storage device includes a nonvolatile memory.

Furthermore, to achieve the object, according to a third aspect of the present invention, there is provided a stencil printing machine which comprises: a printing drum to which a stencil sheet having subjected to a stencil making process is attachable; a printer main body, to which the printing drum is attachable, and which performs printing operation through use of the printing drum; a storage device which is provided in the printing drum and stores information on use of the printing drum; and a control device which is provided in the printer main body, reads out information on use of the printing drum stored in the printing drum, and updates and stores the information in accordance with a print state.

According to a fourth aspect of the present invention, the stencil printing machine may be constructed that the printer main body has a first data transmission/reception device, and the printing drum has a second data transmission/reception device, wherein the first and second transmission/reception devices enable data transmission and reception between the storage device and the control device, and are disposed in a portion at which the printing drum is attached to the printer main body.

According to a fifth aspect of the present invention, the stencil printing machine may be constructed that the control device detects attachment of the printing drum with respect to the printer main body, and reads out, from the storage device, information on the use of the printing drum.

According to a sixth aspect of the present invention, the stencil printing machine may be constructed that when power of the printer main body is turned on, the control device reads out, from the storage device, information on use of the printing drum.

According to a seventh aspect of the present invention, the stencil printing machine may be constructed that the control device writes into the storage device the information on use of the printing drum which has been updated before the printing drum is removed from the printer main body.

According to an eighth aspect of the present invention, the stencil printing machine may be constructed that a number of print products is set as a portion of the information on use of the printing drum, wherein the control device updates information on the number of print products produced during a period in which the printing drum has been attached to the printer main body.

According to a ninth aspect of the present invention, the stencil printing machine may be constructed that the control device compares information on use of the printing drum with preset values, thereby determining whether a continuance of use of the printing drum is possible.

In accordance with the above-described construction, the printing drum (2) is provided with a storage device (25), and information on the use of a printing drum is stored in the storage device (25), thereby enabling the printer main body (1) to manage the state of use of each of the printing drums (2). Accordingly, problems relating to the life and structure of the printing drum (2) and the amount of use of consumable articles can be managed readily.

BRIEF DESCRIPTION OF THE DRAWINGS

The above and other objects and advantages of the present invention will become more apparent by describing in detail preferred embodiments thereof with reference to the accompanying drawings, wherein:

FIG. 2 is a table showing information on use of a printing drum to be stored in a storage device;

FIG. 3 is a flowchart showing management processing to be performed at power-on;

DETAILED DESCRIPTION OF THE PREFERRED EMBODIMENTS

Figure 1:
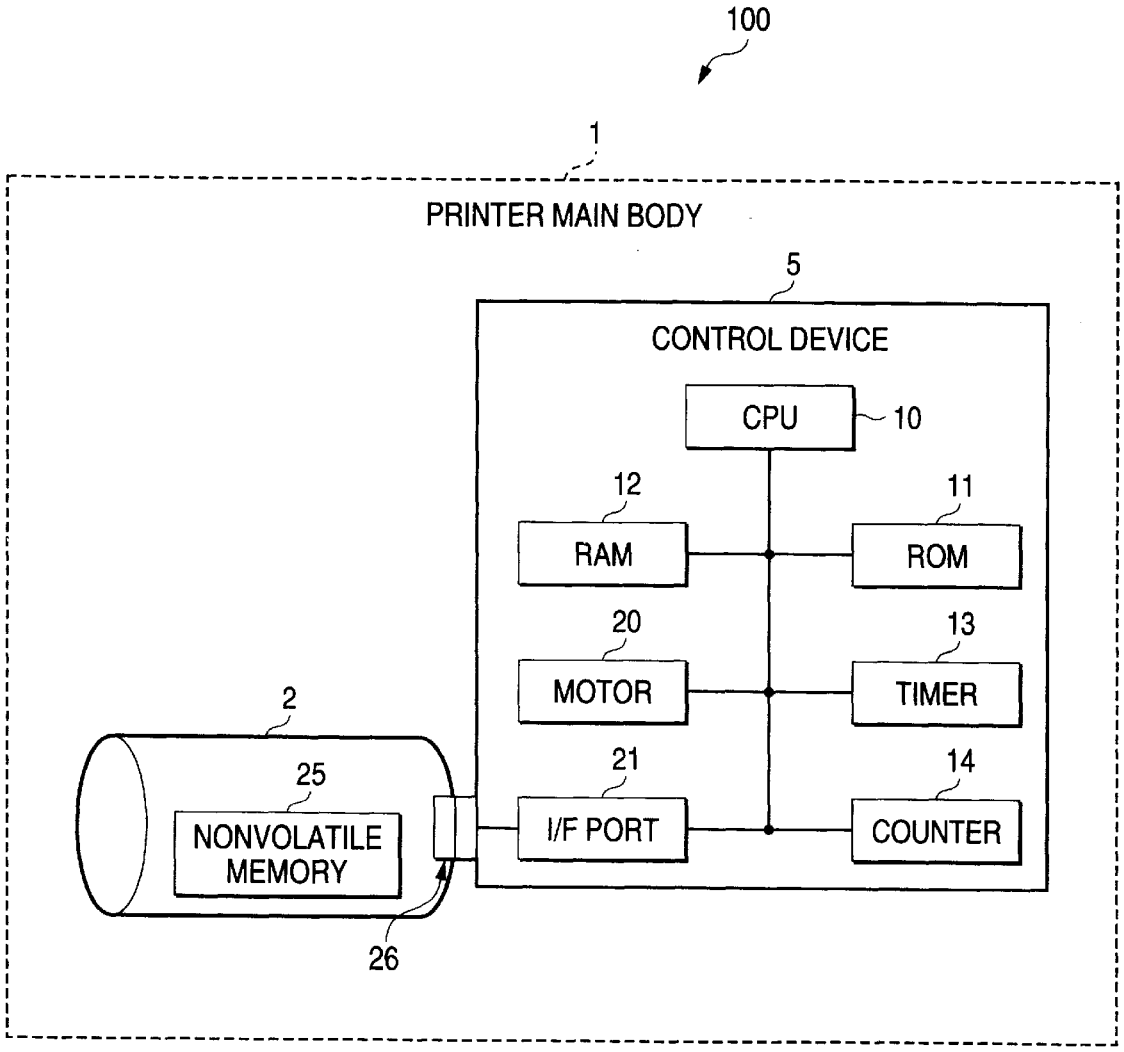
FIG. 1 is a block diagram showing a stencil printing machine according to an embodiment of the present invention.

FIG. 1 is a block diagram showing the construction of a stencil printing machine 100 according to the present invention.

The stencil printing machine 100 is roughly divided into a printer main body 1 and a printing drum 2.

The printing drum 2 is removably attached to a printing section of the printer main body 1. Stencil making operation and printing operation are performed while the printing drum 2 is attached to the printer main body 1. A stencil sheet which has subjected to a stencil making operation in a stencil making section is attached to an outer peripheral surface of the printing drum 2. The printing drum 2 is rotated, and printing paper is fed. By ink which has passed through perforates from the inside of the printing drum 2, an image corresponding to perforates can be formed on printing paper.

The printer main body 1 is provided with a control device 5 for controlling stencil making operation and printing operation. The control device 5 is equipped with a processing device (i.e., CPU) 10, a ROM (i.e., Read Only Memory) 11, a timer 13, a RAM (i.e., Random Access Memory) 12, and a counter 14, and controls operations of individual sections. Particularly, in the present embodiment, the state of use of the printing drum 2 is managed and controlled, as will be described later.

A motor 20 rotatably drives a printing drum during stencil making operation and printing operation. An I/F port 21 performs transmission and reception of information with respect to the printing drum 2.

A nonvolatile memory 25 for storing information on use of a printing drum in an updatable manner is provided in the printing drum 2. The nonvolatile memory 25 includes a memory element which obviates backup power (e.g., a flash memory) or a memory element which retains memory contents by combination of primary and secondary batteries.

When the printing drum 2 is mounted on the printer main body 1, the nonvolatile memory 25 is connected to the I/F port 21 via a data transmission/reception device such as a connector 26 etc.

As a result of execution of a predetermined control program, the CPU 10 stores, from the I/F port 21 and into the nonvolatile memory 25 provided in the printing drum 2, various information items pertaining to a stencil sheet and printing operation; e.g., a print end time, the number of print products, and the number of stencil sheets, via a data transmission/reception device such as a connector 26 etc. Various information items stored in the nonvolatile memory 25 are loaded into the CPU 10 when necessary.

FIG. 2 is a table showing various information items stored in the nonvolatile memory 25 provided in the printing drum 2. As illustrated, "information on use" of the printing drum 2 is stored in the nonvolatile memory 25.

Items (i) through (x) are fixed initial setting values which are written and stored in memory at a factory during manufacturing operation.

(i) Serial number: a number unique to the printing drum 2; printing drums 2 are assigned different numbers beforehand.

(ii) and (iii) Type codes 1 and 2: there are set information on a model name of a printer main body to which the printing drum 2 is attachable, and information on the type of the printing drum 2.

(iv) Number of print products: a life value of the printing drum 2 is set when printing is performed through use of the printing drum 2.

(v) Number of stencil sheets: there is set a life value of a damper for holding a stencil sheet (i.e., the number of times a damper is opened and closed), the stencil sheet being provided on the printing drum 2 and having been subjected to stencil making process.

(vi) Number of times a screen is replaced: there is set a life value of a meshed screen (i.e., the number of times the screen can be replaced) to be provided on the outer peripheral surface of the printing drum 2.

(vii) Number of print products produced by a single stencil: there is set a maximum number of print products produced by a single stencil sheet.

(viii) Number of times a printing drum is attached and removed: there is set a life value of a connector 26 when the printing drum 2 is attached to the printer main body 1.

(ix) Maximum sheet size: there is set the maximum size of paper which can be printed by the printing drum 2.

(x) Minimum sheet size: there is set the minimum size of paper which can be printed by the printing drum 2.

Items (xi) through (xix) are values which are updated by the CPU 10 as "Information on the use" of the printing drum 2.

(xi) Print product count value: this value is updated and stored as a count value pertaining to the number of print products produced by use of the printing drum 2.

(xii) Stencil sheet count value: this value is updated and stored as a count value pertaining to the number of stencil sheets attached to the printing drum 2.

(xiii) Per-stencil print product count value: this value is stored as a count value pertaining to the number of print products produced by a single stencil sheet attached to the printing drum 2.

(xiv) Screen count information value: the number of times a screen has been replaced (the value is incremented by one every time a screen is replaced)

(xv) Drum removal count value: the number of times the printing drum 2 has been attached to the printer main body 1. The attaching action is detected by a switch or sensor for sensing the attached state of a printing drum.

(xvi) Employed colors: information on colors of ink provided on the printing drum 2.

(xvii) Print end date and time: last print date and time—at which printing is performed through use of the printing drum 2—is updated and stored.

(xviii) Update check information: when "Information on the use" items (xi) through (xvii) are normally updated, the information is updated and stored as predetermined information (e.g., bit "1" at the time of normal update).

(xix) User information and other information items: arbitrary information is written as remarks of "User Information" about the printing drum 2.

Management and control of "Information on the use" of the printing drum having the foregoing construction now will be described.

Figure 3:
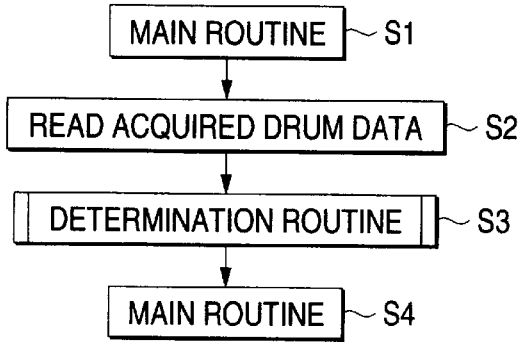

FIG. 3 is a flowchart showing processing to be performed by the CPU 10 when the power of the printer main body 1 is turned on.

When power of the printer main body 1 is turned on, the CPU 10 controls activation of individual sections of the printer main body 1 according to a main routine (see S1). The main routine (not shown) defines execution of overall control operations pertaining to stencil-making operation and printing operation of the printer main body 1.

During the course of these processing operations, all the information items stored in the nonvolatile memory 25 (i.e., (i) through (xix) shown in FIG. 2) are read (see S2), and the information items are then stored in the RAM 12.

Subsequently, a predetermined determination routine (to be described later) is performed, thereby determining the state of use of the printing drum (see S3). If use of the printing drum 2 is permitted, processing returns to the main routine, and stencil-making and printing operations to be performed through use of the printing drum 2 are granted and carried out (see S4).

As mentioned above, the CPU 10 reads out all "Information on the use" items from the nonvolatile memory 25 of the printing drum 2 at the time of activation of power of the printer main body 1. Accordingly, even if the printing drum 2 has been replaced with the other printing drum during a power-off period of the printer main body 1, since the CPU 10 reads out "Information on the use" of the other printing drum from the nonvolatile memory thereof at the time of activation of power of the printer main body 1, the state of use of such the newly-replaced printing drum can be easily determined.

Figure 4:
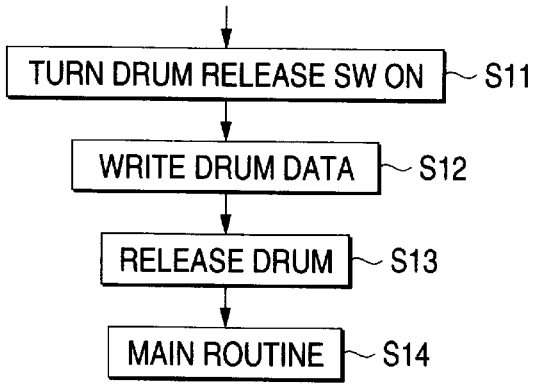
FIG. 4 is a flowchart showing management processing to be performed at the time of removal of a printing drum.

FIG. 4 is a flowchart showing processing to be performed when the printing drum 2 is removed from the printer main body 1.

A drum release button is pressed for removing the printing drum 2 from the printer main body 1 (see S11). Then, the CPU 10 stores into the nonvolatile memory 25 of the printing drum 2 (see S12) all the "User Information" items stored in the RAM 12.

Subsequently, the printer main body 1 releases a removal mechanism of the printing drum 2, thereby enabling removal of the printing drum 2 from the printer main body 1 (see S13). Subsequently, processing returns to the main routine (see S14).

Figure 5:
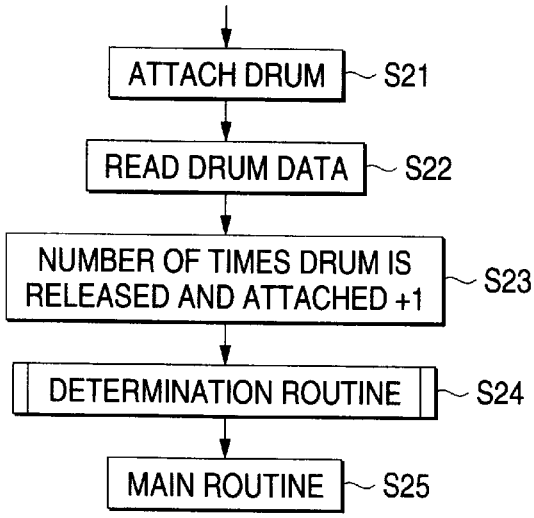
FIG. 5 is a flowchart showing management processing to be performed when a printing drum is attached to a printer main body.

FIG. 5 is a flowchart showing processing to be performed when the printing drum 2 is attached to the printer main body 1.

When the printing drum 2 is attached to the printer main body 1 (see S21), the CPU 10 reads all the "Information on the use" items stored in the nonvolatile memory 25 of the printing drum (see S22).

Subsequently, the CPU 10 updates and stores, into the RAM 12, a value obtained by way of incrementing by one the drum removal count value (xv) from among the thus-read information items (see S23).

Subsequently, a determination routine (which will be described later) is executed (see S24), and the state of use of the printing drum 2 is determined from the "Information on the use" of the attached printing drum 2. If use of the printing drum 2 is permitted, processing returns to the main routine. Stencil making operation and printing operation to be performed through use of the printing drum 2 are allowed and performed (see S25).

Figure 6:
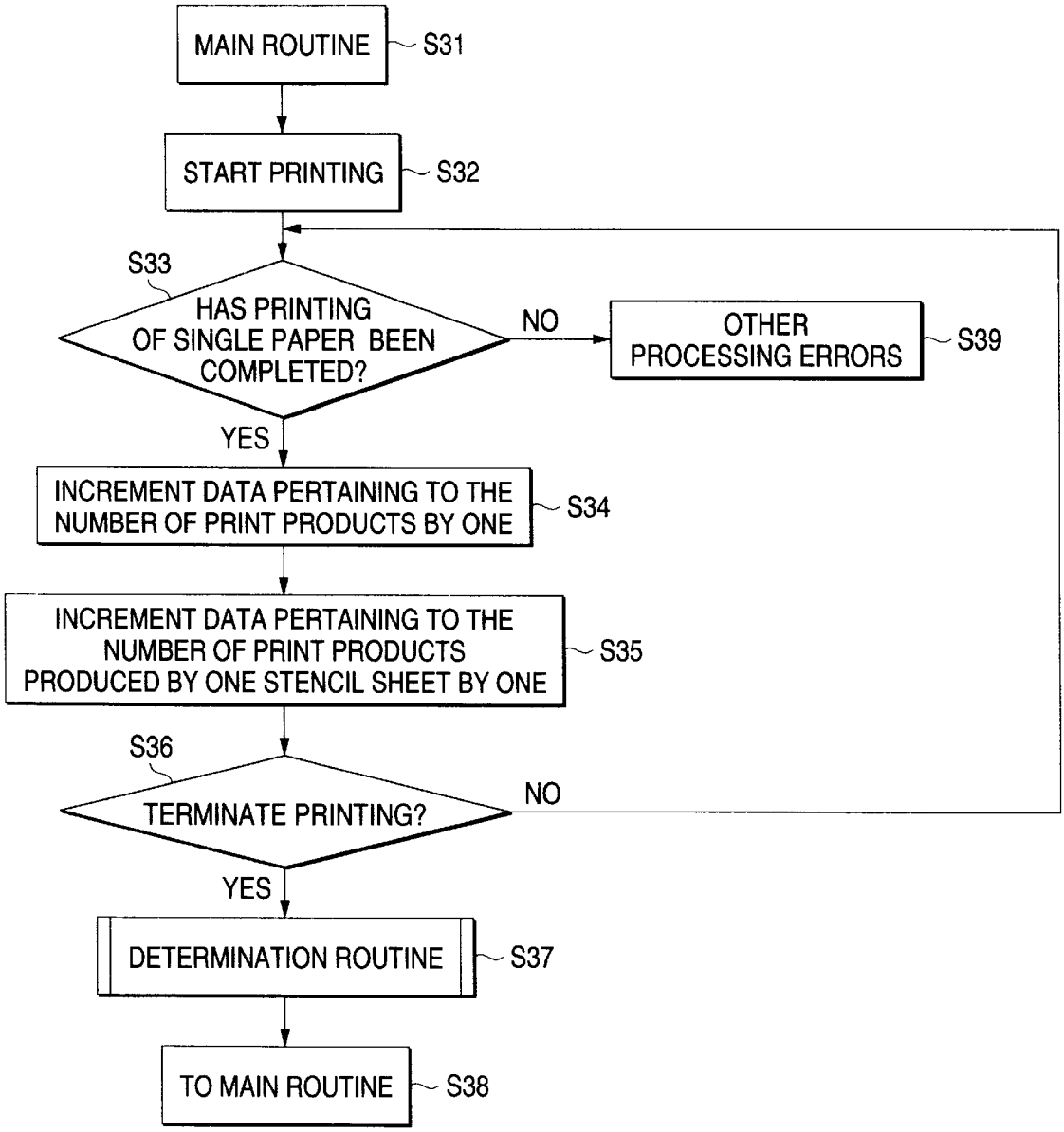
FIG. 6 is a flowchart showing management processing to be performed during printing operation.

FIG. 6 is a flowchart showing processing to be performed during printing operation.

When a print start is instructed during the main routine S31 (see S32), there is updated and stored a value which is obtained by incrementing by one the print product count value (xi) from among the "Information on the use" stored in the RAM 12 (see S34) every time printing of one sheet is completed (YES is selected in S33).

Next, a value obtained by way of incrementing by one the per-stencil print product count value (xiii) is updated and stored (see S35).

The foregoing processing operations are intermittently performed until printing operation ends (loop processing subsequent to selection of NO in step S36). When printing of a predetermined number of print products set on the printer main body 1 is completed (YES is selected in S36), a determination routine (which will be described later) is performed (see S37). The state of use of the printing drum 2 is determined from the "Information on the use" of the attached printing drum 2. Subsequently, processing returns to the main routine (see S38). When printing is stopped in midstream (when NO is selected in S33), a processing flow for terminating printing operation in midstream is performed (see S39). An alarm is sounded when an error determination is made.

Figure 7:
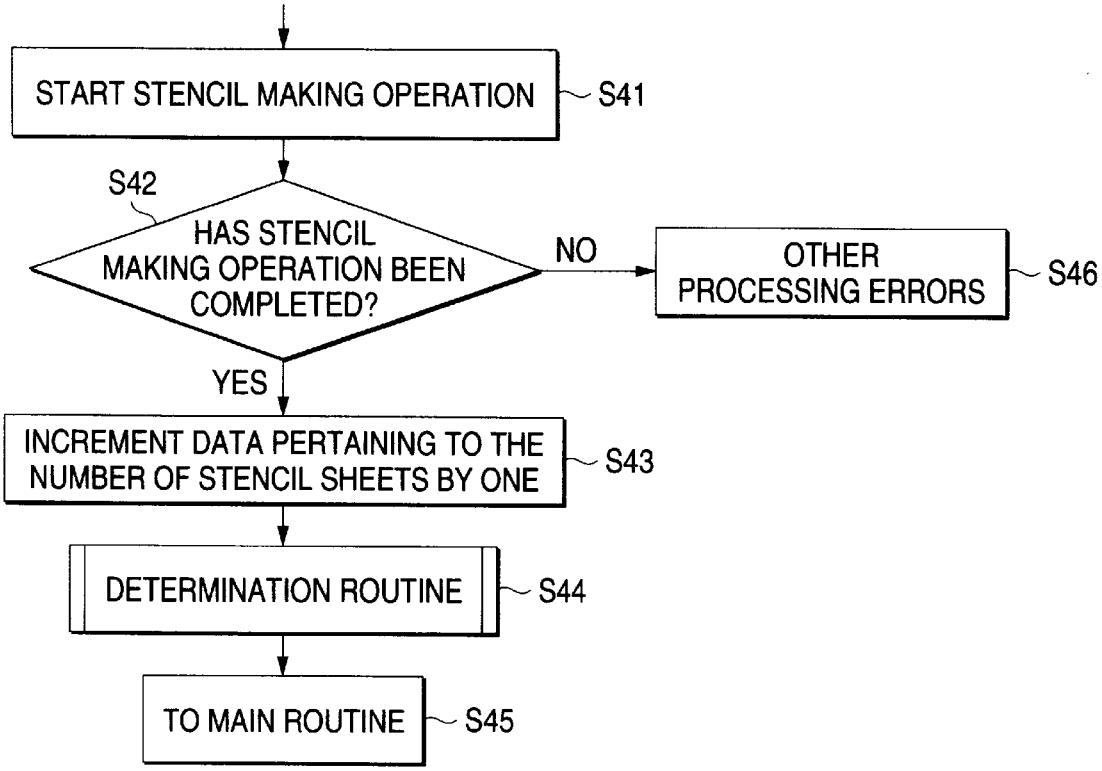
FIG. 7 is a flowchart showing management processing to be performed during stencil making operation.

FIG. 7 is a flowchart showing processing required for making a stencil.

Making a new stencil sheet to be attached to the printing drum 2 is commenced (see S41). When preparation of the new stencil sheet has been completed normally (YES is selected in S42), the stencil sheet count value (xii) of the "Information on the use" is incremented by one, and the thus-updated stencil sheet count value is stored (see S43).

Subsequently, a determination routine (which will be described later) is executed (see S44), thereby determining the state of use of the printing drum 2 from the "Information on the use" of the thus-attached printing drum 2. Then, processing returns to the main routine (see S45). When stencil making operation is stopped in midstream in S42, a processing flow for terminating stencil making operation in midstream is performed (see S46). An alarm is sounded when an error determination is made.

Figure 8:
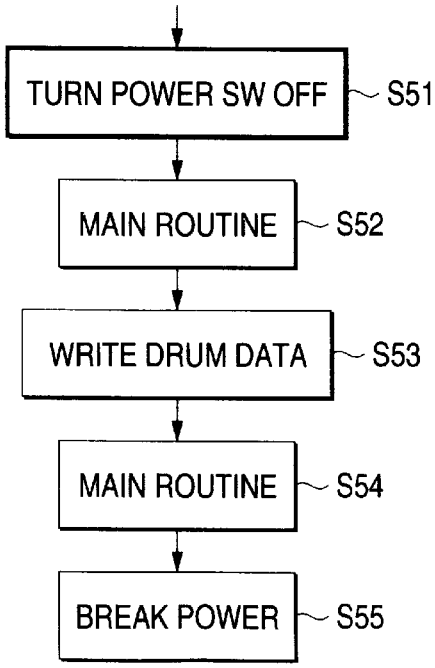
FIG. 8 is a flowchart showing management processing to be performed at the time of power-off.

FIG. 8 is a flowchart showing processing performed when power of the printer main body 1 is turned off.

When a power switch of the printer main body 1 is turned off (see S51), the CPU 10 controls termination of individual sections of the printer main body 1 by the main routine (see S52).

During the course of the processing, all the "Information on the use" items stored in the RAM 12 of the printer main body 1 are read (see S53), and the thus-read information items are stored in the nonvolatile memory 25 of the printing drum 2 (see S54).

Subsequently, power-off processing (see S55) is executed, thereby breaking power.

Figure 9:
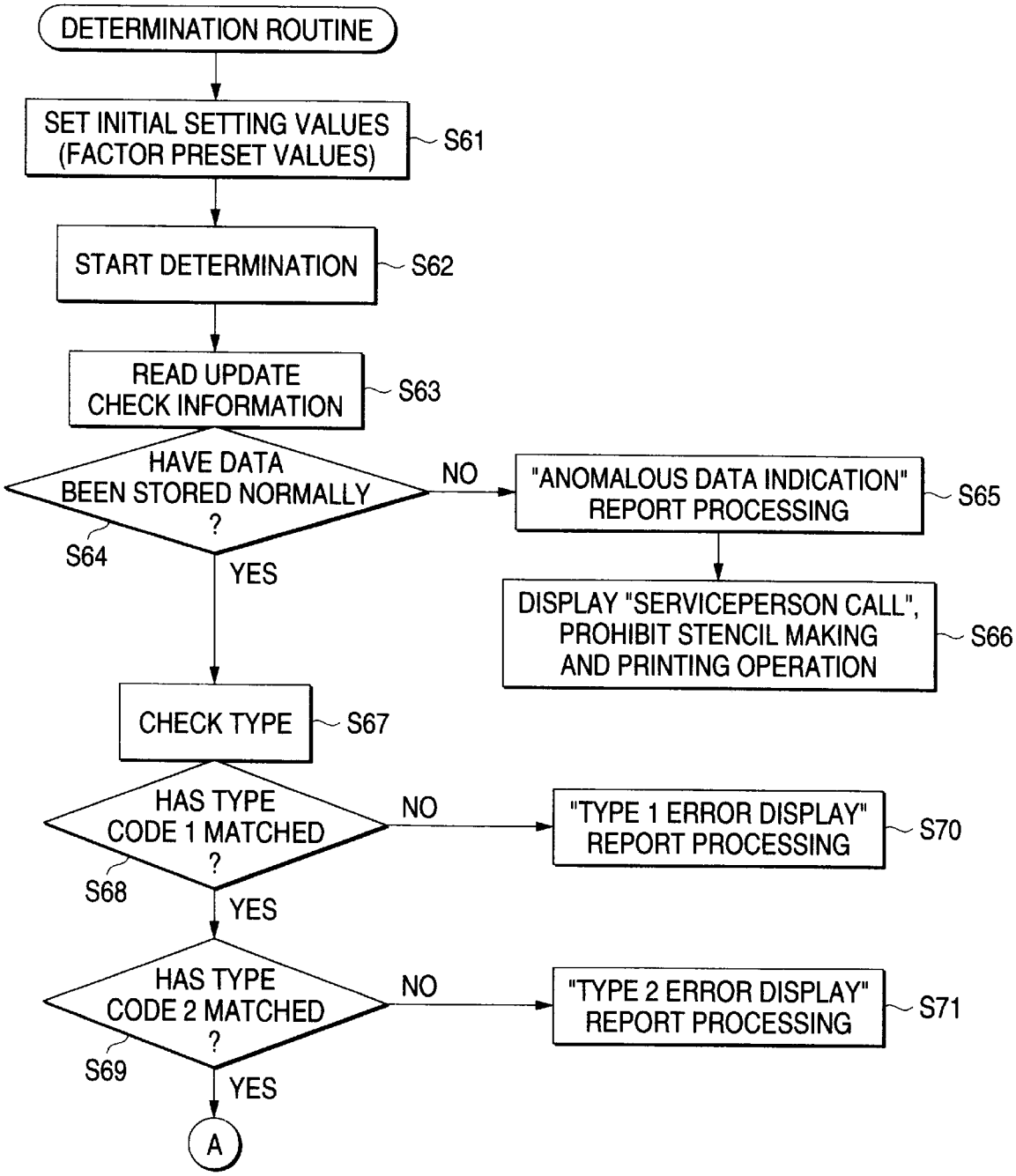
FIG. 9 is a flowchart showing management processing to be performed when a determination is made as to the state of use of the printing drum (Part 1)
Figure 10:
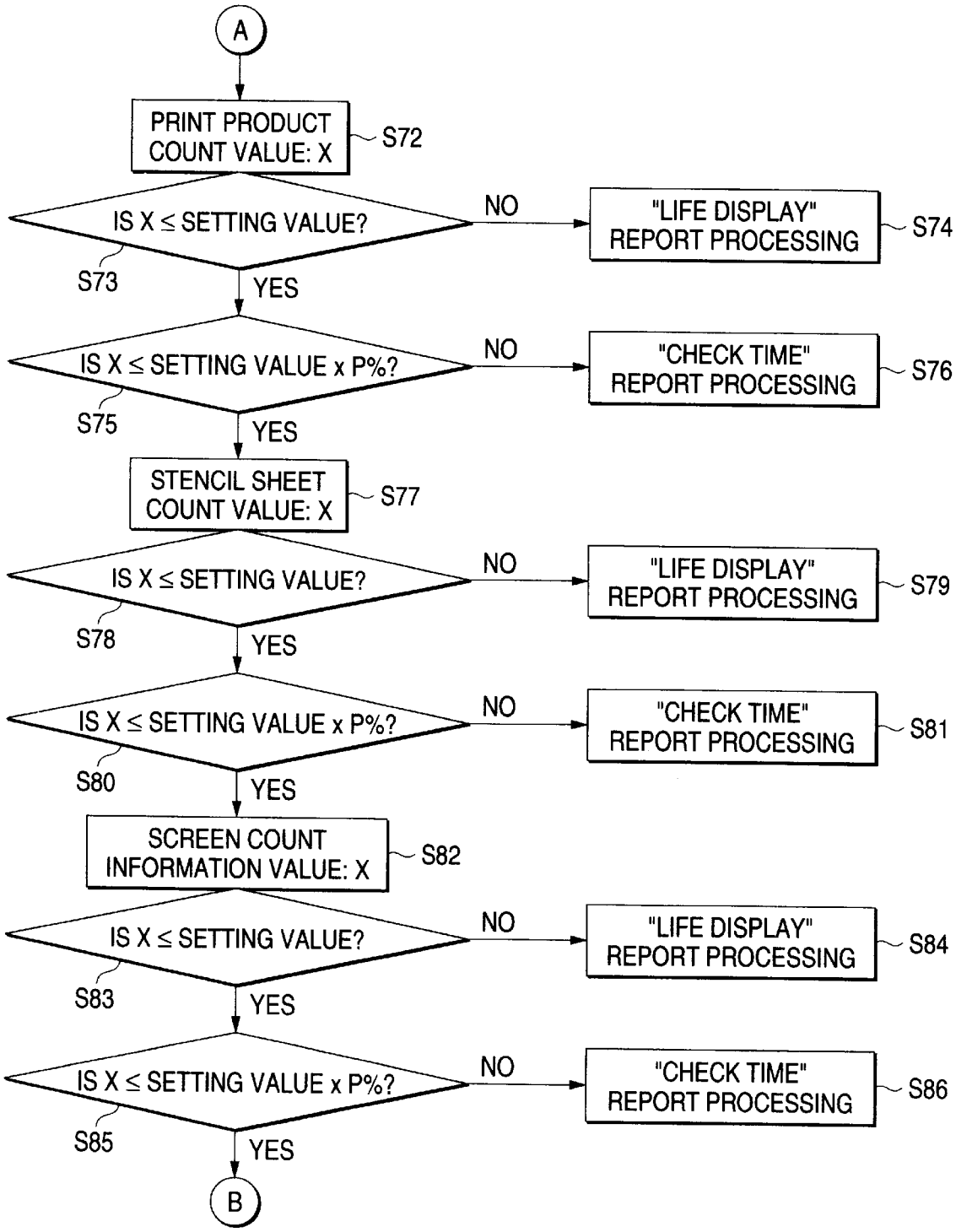
FIG. 10 is a flowchart showing management processing to be performed when a determination is made as to the state of use of the printing drum (Part 2)
Figure 11:
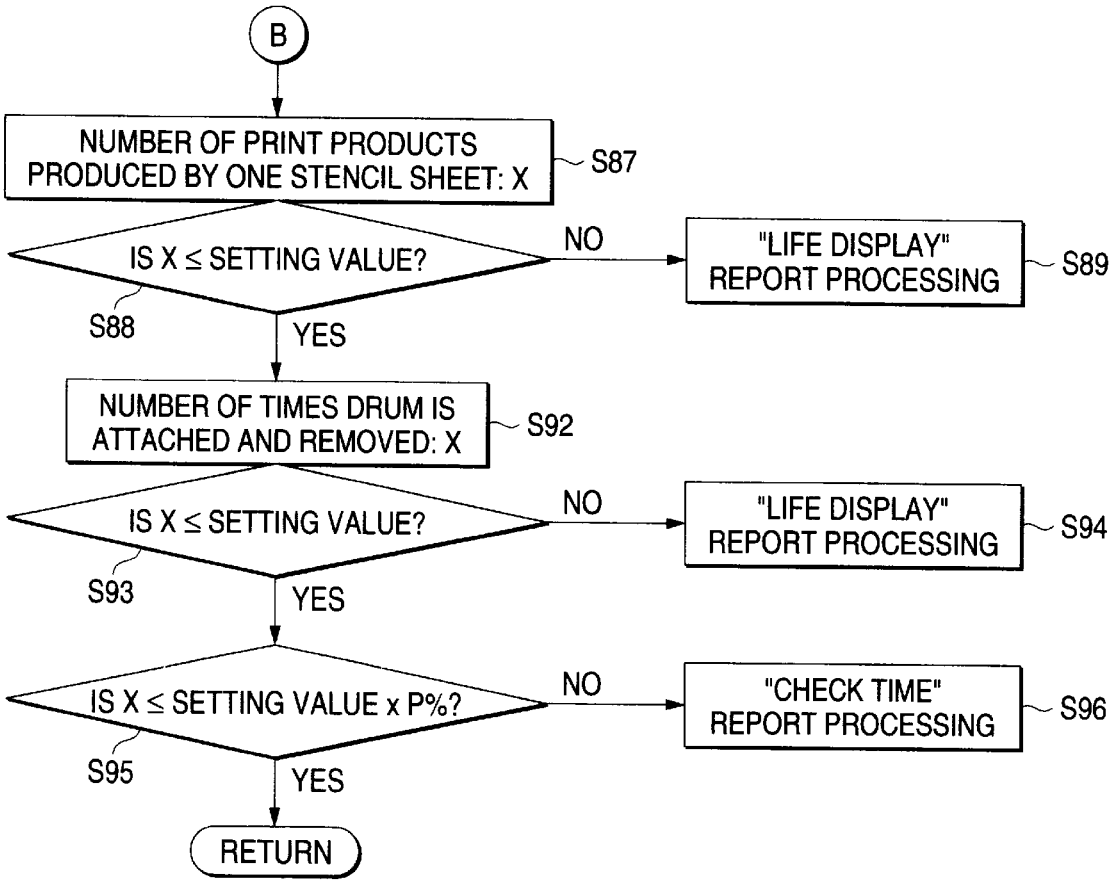
FIG. 11 is a flowchart showing management processing to be performed when a determination is made as to the state of use of the printing drum (Part 3)

FIGS. 9 through 11 are flowcharts showing details of the previously-described determination routine.

In the determination routine, the status of the printing drum 12 at the time of processing being performed is detected on the basis of the "Information on the use" of the printing drum.

Of the read "Information on the use," initial setting values of items (i) through (x) are set in a predetermined location (see S61), thereby commencing determination processing (see S62). Next, the update check information (xviii) is read (see S63), thereby determining whether or not data are properly stored (see S64). When the update check information shows an anomaly (when NO is selected in S64), information on operating status is determined to be anomalous. After an alarm has been sent to the outside by way of displaying an anomalous state (see S65), an indication for calling a maintenance serviceperson is displayed, thereby prohibiting stencil making and printing operations (see S66).

When update is determined to be normal (when YES is selected in S64), type codes (ii, iii) are read (see S67). The type of the printing drum 2 is determined by the type codes 1 and 2 (see S68 and S69). If the printing drums 2 have been determined to differ in type from each other through determination processing, statements indicating that the printing drums 2 differ in type from each other are displayed, thereby prohibiting stencil making and printing operations (see S70 and S71).

Next, in order to determine the number of print products, a print product count value (xi) is read (see S72). In the following descriptions, a count value is a value obtained by the counter 14 performs counting operation in association with printing operation.

An initial setting value pertaining to the number of print products (iv) is compared with the print product count value X (xi) (see S73). As a result of the comparison, if the print product count value X has not reached an initial setting value, it is determined that the number of print products has not reached a life value (when YES is selected in S73). In contrast, when the print product count value X has reached an initial setting value (when NO is selected in S73), it is determined that the number of print products produced by use of the printing drum 2 has reached the life value. A statement indicating that the printing drum 2 has reached its life is displayed (see S74).

Next, a determination is made as to whether the printing drum 2 is to be checked (see S75). The timing at which the printing drum 2 is to be checked (simply called a "check time") is defined as the product of P % and the initial setting value pertaining to the number of print products (iv). The check time is reported when a life determined by has been approached.

If the print product count value X has not reached the product (of the number of print products and P %), it is determined that the check time has not been reached (when YES is selected in S75). In contrast, when the print product count value X has reached the product (of the number of print products and P %) (when NO is selected in S75), the time at which the printing drum 2 is to be checked has been reached, thereby indicating that the printing drum 2 is to be checked (see S76).

In order to determine the number of stencil products, a stencil sheet count value (xii) is read (see S77). Then, an initial setting value pertaining to the number of stencil sheets (v) is compared with the stencil sheet count value X (xii) (see S78). If a result of comparison shows that the stencil sheet count number X has not reached the initial setting value, it is determined that the number of stencil sheets has not reached a life value (when YES is selected in S78). In contrast, when the stencil sheet count value X has reached the initial setting value (when NO is selected in S78), it is determined that the number of stencil sheets employed by the printing drum 2 has reached a life value, and a statement indicating that the printing drum 2 (particularly, a drive section of a clamper) has reached a life value is displayed (see S79).

Next, a determination is made as to whether the printing drum 2 (clamper) is to be checked (see S80). The timing at which the printing drum 2 is to be checked (simply called a "check time") is defined as the product of P % and the initial setting value pertaining to the number of stencil sheets (v). The check time is reported when a life determined by has been approached.

If the stencil sheet count value X has not reached the product (of the number of stencil sheets and P %), it is determined that the check time has not been reached (when YES is selected in S80) In contrast, when the stencil sheet count value X has reached the product (of the number of stencil sheets and P %) (when NO is selected in S80), the time at which the printing drum 2 is to be checked has been reached, thereby indicating that the printing drum 2 is to be checked (see S81).

In order to determine a screen status, a screen count information value (xiv) is read (see S82). Then, an initial setting value pertaining to the number of times a screen is to be replaced (vi) is compared with the screen count information value X (xiv) (see S83). If a result of comparison shows that the screen count information value X has not reached the initial setting value, it is determined that the number of times a screen has been replaced has not reached a life value (i.e., limitation) (when YES is selected in S83). In contrast, when the screen count information value X has reached the initial setting value (when NO is selected in S83), it is determined that the number of times a screen of the printing drum 2 has been replaced has reached a limitation, and a statement indicating that the printing drum 2 (particularly, a screen portion of the printing drum 2 which is to be replaced) has reached a life value is displayed (see S84).

Next, a determination is made as to whether the printing drum 2 (screen) is to be checked (see S85) The timing at which the printing drum 2 is to be checked (simply called a "check time") is defined as the product of P % and the initial setting value pertaining to the number of times a screen is to be replaced (vi). The check time is reported when the number of replacements determined as has approached a limitation.

If the screen count information value X has not reached the product (of the number of times a screen is to be replaced and P %), it is determined that the check time has not been reached (when YES is selected in S85). In contrast, when the screen count information value X has reached the product (of the number of times a screen is to be replaced and P %) (when NO is selected in S85), the time at which the printing drum 2 (particularly a screen portion of the printing drum 2 which is to be replaced) is to be checked has been reached, thereby indicating that the printing drum 2 is to be checked (see S86).

In order to determine a state of printing performed through use of a single stencil (i.e., a single stencil sheet), a per-stencil print product count value (xiii) is read (see S87). Then, an initial setting value pertaining to the number of print products produced by a single stencil (vii) is compared with the per-stencil print product count value X (xiii) (see S88). If a result of comparison shows that the per-stencil print product count value X has not reached the initial setting value, it is determined that the number of print products produced through use of the stencil sheet has not reached a life value (i.e., limitation) (when YES is selected in S88). In contrast, when the per-stencil print product count value X has reached the initial setting value (when NO is selected in S88), it is determined that the number of print products produced through use of the stencil sheet currently attached to the printing drum 2 has reached a limitation, and a statement indicating that the stencil sheet has reached a life value is displayed (see S89).

In order to determine the number of times the printing drum 2 is attached to and removed from the printer main body 1 (i.e., the number of times the printing drum 2 is attached), the drum removal count value (xv) is read (see S92). Then, an initial setting value pertaining to the number of times a printing drum is to be attached and removed (viii) is compared with the drum removal count value X (xv) (see S93). If a result of comparison shows that the drum removal count value X has not reached the initial setting value, it is determined that the number of times the printing drum 2 has been attached and removed has not achieved a life value (when YES is selected in S93). In contrast, when the drum removal count value X has reached the initial setting value (when NO is selected in S93), it is determined that the number of times the printing drum 2 has been attached and removed to and from the printer main body 1 (i.e., the number of times the printing drum 2 has been attached) has reached a life value, and a statement particularly indicating that the connector 26 has reached a life value is displayed (see S94). From the foregoing description, management of life of components provided around signal connection, such as a connector 26, becomes feasible.

Next, a determination is made as to whether the number of times the printing drum 2 has been attached and removed is to be checked (see S95). The timing at which the printing drum 2 is to be checked (simply called a "check time") is defined as the product of P % and the initial setting value pertaining to the number of a printing drum is to be attached and removed (viii). The check time is reported when the number of times the printing drum 2 has been attached has approached.

If the drum removal count value X has not reached the product (of the number of times a printing drum is to be removed and attached and P %), it is determined that the check time has not been reached (when YES is selected in S95). In contrast, when the drum removal count value X has reached the product (of the number of times a printing drum is to be removed and attached and P %) (when NO is selected in S95), the time at which the printing drum 2 is to be checked has been reached, thereby indicating that the connector 26 is to be checked (see S96).

The data transmission/reception device is not limited to the connector 26 of contact type but may include any of various types of devices which send a signal in a non-contact manner and employ an infrared ray, an antenna, a coil, etc.

The determination processing set forth may be implemented by way of setting the CPU 10 to perform only arbitrary items or a plurality of items in combination.

Figure 12:
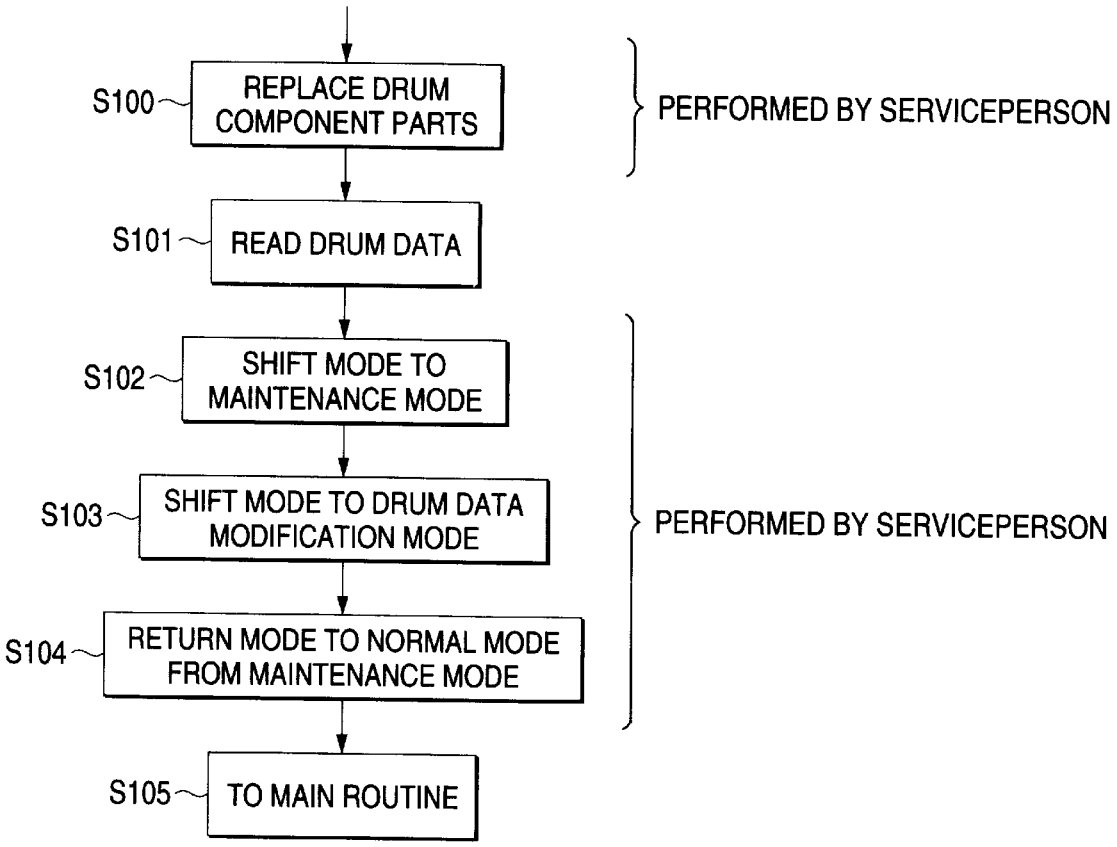
FIG. 12 is a flowchart showing management processing to be performed at the time of maintenance.

FIG. 12 is a flowchart showing processing to be performed by an expert serviceperson at the time of maintenance.

When component parts constructing the printing drum 2 are replaced (see S100), the serviceperson attaches the replaced printing drum 2 to the printer main body 2. The CPU 10 performs an attachment processing shown in FIG. 5 (see S101), thereby reading all the "Information on the use" items stored in the nonvolatile memory 25 of the printing drum 2. The thus-read information items are stored in the RAM 12.

At this time, the serviceperson selects a maintenance mode differing from normal processing in association with replacement of parts (see S102).

In the maintenance mode, the "Information on the use" read out from the nonvolatile memory 25 are modified (see S103). For instance, when a screen is to be replaced, there is performed an input operation for incrementing the screen count information value (xiv) by one.

The thus-modified "Information on the use" is again stored in the nonvolatile memory 25, thereby terminating the maintenance mode. The printing machine then returns to a normal mode (see S104), and processing returns to the main routine (see S105).

In the above descriptions, "Information on the use" is modified while the printing drum 2 is attached to the printer main body 1. However, the manner of modifying the "Information on the use" is not limited to this method. Alternatively, maintenance equipment, such as a personal computer, is connected directly to the printing drum 2 without the printing drum 2 being connected to the printer main body 1, thereby reading out the data stored in the nonvolatile memory 25 or writing data into the same.

Further, the items pertaining to the "Information on the use" can also be modified or added. For instance, in addition to the items pertaining to parts of the printing drum 2 (i.e., a connector and a screen), if a count value and a history of replacement are updated on a per-component of other basic consumable items constructing the printing drum 2, the state of use and replacement of components constructing the printing drum 2 can be managed, thereby facilitating maintenance and saving of resources.

A setting value (P %) used for determining whether check is to be performed can be set individually so as to suit a durability value of each of component parts. The setting value may be set into relatively lowered values in a plurality of phases. As a result, the state of use (i.e., life) can be reported to the user in stages, thereby enabling avoidance of trouble in advance.

Change of material to lighter-weight material or management of low-cost articles can be performed in combination with lowering of setting values.

1. First Example Use of Drum

Next, a first example use of the printing drum 2 using the foregoing "Information on the use" will be described. This example relates to a case where a single printer main body 1 employs a plurality of printing drums 2 in a replaceable manner.

Figure 13:
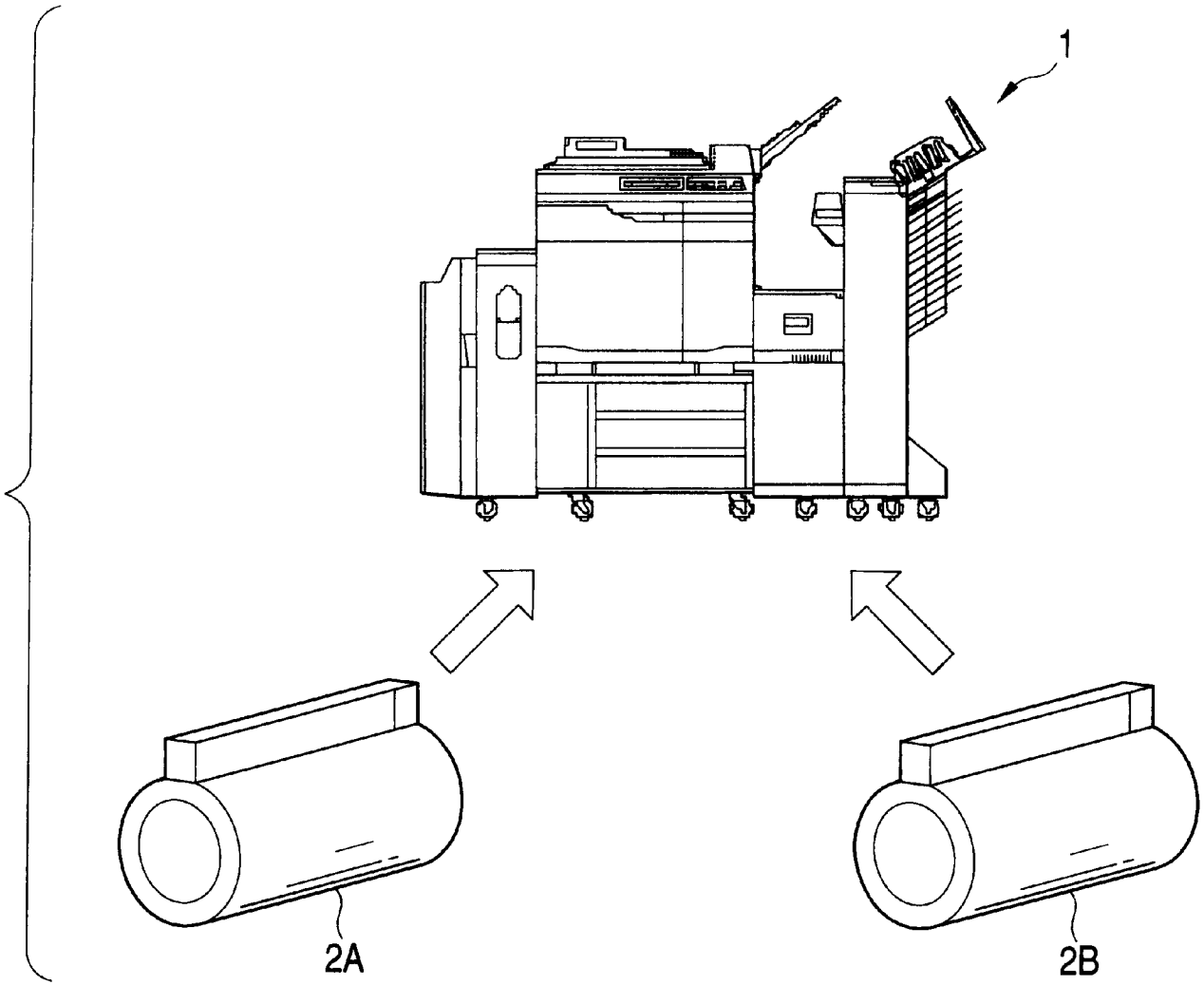
FIG. 13 is an overview for explaining a first example use of the printing drum according to the present invention.

As shown in FIG. 13, in relation to a stencil printing machine 100, a single printer main body 1 sometimes employs, in a replaceable manner, printing drums 2A and 2B having different ink colors.

In the related art, when the printing drums 2A and 2B are employed, the status of use of each of the printing drums 2A and 2B cannot be grasped from insertion and extraction of the printing drum 2. However, the present invention enables ascertainment of wear of component parts constructing each of the printing drums 2A and 2B, thereby preventing occurrence of a problem.

For instance, in the related art if only one ink color and one printing drum 2 are employed, the state of use of the printer main body 1 and that of the drum can be ascertained by way of glancing at only a "print product and stencil sheet counter" provided on the printer main body 1.

According to the present invention, each of the printing drums 2A and 2B stores "Information on the use" of a printing drum. Every time a printing drum is attached to the printer main body 1, "Information on the use" of a printing drum is read out from the printing drum 2A or 2B. Even when the single printer main body 1 employs the two printing drums 2A and 2B of two colors in a replaceable manner, the current state of use of the printing drums 2A and 2B can be ascertained.

As a result of ascertainment of use of the printing drums 2, the state of use of the entire stencil printing system including the printer main body 1 can be managed, thereby facilitating maintenance. Further, the life of the printing drum 2 can be set and ascertained. For instance, even when the structural durability of the printing drum 2 is lowered in association with a reduction of noise and weight of the printing drum 2, the life of the printing drum can be managed appropriately.

2. Second Example Use of Drum

A second example use of a printing drum will now be described. This example relates to a case where a plurality of printing machine main bodies 1 employ a plurality of printing drums 2 in combination.

Figure 14:
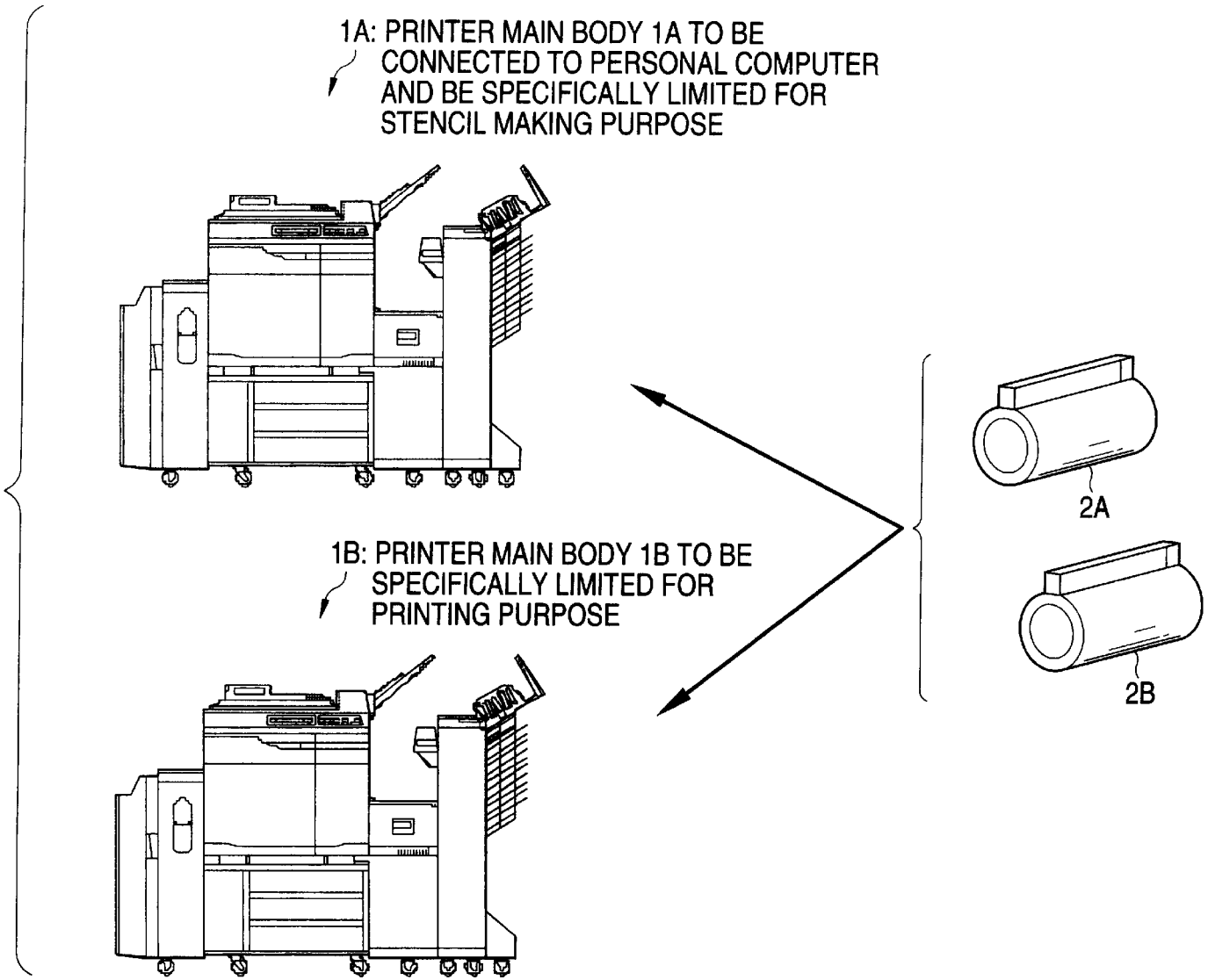
FIG. 14 is an overview for explaining a second example use of the printing drum according to the present invention.

FIG. 14 shows an example in which a plurality of printing machine main bodies 1A and 1B and a plurality of printing drums 2A and 2B are used in combination.

For example, when only one printer main body 1A is connected to a personal computer in a print shop, the printer main body 1A is employed specifically for use with a stencil sheet. There may be a case where printing drums 2A and 2B having stencil sheets that have subjected to stencil making processes are used with another printer main body 1B. Thus, the remaining printer main body 1B is employed specifically for printing purpose. Thus, stencil making operation and printing operation can be performed in parallel, thus improving the efficiency of processing.

In this case, according to the present invention, even when the printing drums 2A and 2B that have been used in the printer main body 1B are later returned to the original printer main body 1A, the printer main body 1A can grasp the use statuses of the printing drums 2A and 2B. For example, there can be eliminated a problem of the number of print products indicated by the printer main body 1A showing a value lower than the actual number of print products.

More specifically, it is assumed that the printing drum 2A having attached thereon a stencil sheet having subjected to a stencil making process in the printer main body 1A is attached to the printer main body 1B; that a predetermined number of print products are produced; and that the printing drum 2A is returned to the printer main body 1A after printing. In this case, if an attempt is made to manage the use state of the printing drum by only the printer main body 1, the following problems may arise in the related art:

The number of print products is not added to the print product count value made by the printer main body 1A.

The printing drum 2A is actually used for printing in number greater than the number of print products added by the printer main body 1A.

Thus, the use state of the printing drum 2A cannot be ascertained by only the print product count value of the printer main body 1A. The number of print products actually produced by the printing drum 2A is greater than the count value made by the printer main body 1A. Thus, the life of the printing drum 2A cannot be ascertained.

In this regard, the printing drum 2A stores "Information on the use," and the "Information on the use" is read out from the printing drum 2A every time the printing drum 2A is attached to the printing machine main bodies 1A and 1B. Hence, even when the printing drum 2A is attached to the two printing machine main bodies 1A and 1B, the latest use state of the printing drum 2A can be grasped.

Even when a plurality of printing machine main bodies 1 employ a plurality of printing drums 2 and when an arbitrary printing drum 2 is attached to and used with an arbitrary printer main body 1, the printer main body 1 can ascertain the use status of each of the printing drums 2.

On the basis of the per-stencil print product count value, either the printer main body 1A or 1B can manage the number of print products produced on a per-stencil basis. On the basis of the number of print products, a billing operation can be performed accurately in print shops.

In association with an improvement in the printer main body 1, the printer main body 1 of another generation (i.e., of a different series) is often constructed so as to have compatibility such that a printing drum 2 of old type can be used in the printer main body 1. Even in such a case, a newly-introduced printer main body 1 can ascertain the use state of the old printing drum 2, thereby enabling management of life of the printing drum 2 and saving the user's time and effort.

At the time of reading and writing of "Information on the use" described in connection with the respective embodiments, the information may be doubly stored in different address locations. The CPU 10 may compare the pair of information items, thereby determining consistency. Double storage of information can be effected by use of either a nonvolatile memory or the RAM 12, which constructs the storage device 4, or use of both in combination. As a result, influence of a distance between the storage device 4 and the control device 5 and influence of transmission performance of the connector 26 can be eliminated.

A printing drum according to the present invention stores, into the internal storage device, information on use of the printing drum. The use state of the printing drum can be transmitted to a printer main body on which the printing drum is to be attached. As a result, the printing drum can be managed at low cost, accurately, and easily. For instance, life of a printing drum, structural problems, and the amount of use of consumable products such as ink can be managed readily.

A nonvolatile memory may serve as a storage device, thereby reducing the size and weight of a printing drum. Further, the printer main body can readily read out stored data.

In the stencil printing machine according to the present invention, the printer main body reads out information on use of a printing drum from the storage device of the printing drum while the printing drum is attached to the printer main body and updates the information in accordance with a printing state, thereby enabling management of use of an attached printing drum. Further, the printing drum can gain at any time the latest information on use. As a result, even when a plurality of printing drums are attached to a single printer main body, the printing drums can be managed on a per-drum basis. Further, even when a single printing drum is used with a plurality of printing machine main bodies, the state of use of the printing drum can be managed.

A storage device of the printing drum and a control device of the printer main body can realize two-way data transmission via transmission/reception devices such as connectors disposed in a portion at which the printing drum is to be attached to the printer main body. Information on use of a printing drum can be transmitted by way of a simple construction.

Information on use of a printing drum stored in the printing drum is loaded into the printer main body when the printing drum is attached to the printer main body or when power of the printer main body is turned on. In accordance with a change in the print status, such as the number of print products, the information is updated. Prior to removal of the printing drum, the information is stored into the storage device of the printing drum. As a result, information on the use of a printing drum can be updated at all times.

So long as a value to be used as an object for comparison is set beforehand and a value of information on the current use of a printing drum is compared with the preset value, a determination can be made as to whether or not a continuance of use of a printing drum is possible. Life of a printing drum, structural problems, and the amount of use of consumable articles such as ink can be managed readily.

It is contemplated that numerous modifications may be made to the stencil printing machine and the printing drum thereof, of the present invention without departing from the spirit and scope of the invention as defined in the following claims.

What is claimed is:

1. A printing drum, to which a stencil sheet having subjected to a stencil making process is attachable, and which is attachable to a printer main body of a stencil printing machine for performing printing, comprising:

a storage device which stores information on use of the printing drum, wherein the information on use of the printing drum includes at least one of a plurality of count values of the printing drum.

2. The printing drum of claim 1, wherein the storage device includes a nonvolatile memory.

3. The stencil printing machine according to claim 1, wherein said information on use of the printing drum further includes fixed initial settings of the printing drum.

4. A stencil printing machine, comprising:

a printing drum to which a stencil sheet having subjected to a stencil making process is attachable;

a printer main body, to which the printing drum is attachable, and which performs printing operation through use of the printing drum;

a storage device which is provided in the printing drum and stores information on use of the printing drum; and a control device which is provided in the printer main body, reads out information on use of the printing drum stored in the printing drum, and updates and stores the information in accordance with a print state, wherein the information on use of the printing drum includes at least one of a plurality of count values of the printing drum.

5. The stencil printing machine of claim 4, wherein the printer main body has a first data transmission/reception device, and the printing drum has a second data transmission/reception device, and wherein the first and second transmission/reception devices enable data transmission and reception between the storage device and the control device, and are disposed in a portion at which the printing drum is attached to the printer main body.

6. The stencil printing machine of claim 4, wherein the control device detects attachment of the printing drum with respect to the printer main body, and reads out, from the storage device, information on the use of the printing drum.

7. The stencil printing machine of claim 4, wherein when power of the printer main body is turned on, the control device reads out, from the storage device, information on use of the printing drum.

8. The stencil printing machine of claim 4, wherein the control device writes into the storage device the information on use of the printing drum which has been updated before the printing drum is removed from the printer main body.

9. The stencil printing machine of claim 4, wherein a number of print products is set as a portion of the information on use of the printing drum, and wherein the control device updates information on the number of print products produced during a period in which the printing drum has been attached to the printer main body.

10. The stencil printing machine of claim 4, wherein the control device compares information on use of the printing drum with preset values, thereby determining whether a continuance of use of the printing drum is possible.

* * * * *